US006652009B2

(12) United States Patent
Fisher et al.

(10) Patent No.: US 6,652,009 B2
(45) Date of Patent: Nov. 25, 2003

(54) ACTUATOR

(75) Inventors: Sidney Fisher, Solihull (GB); Jagjiwan Birdi, Birmingham (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/911,920

(22) Filed: Jul. 24, 2001

(65) Prior Publication Data

US 2002/0014775 A1 Feb. 7, 2002

(30) Foreign Application Priority Data

Jul. 25, 2000 (GB) ..... 0018102

(51) Int. Cl.[7] ..... E05C 17/56; E05C 3/03
(52) U.S. Cl. ..... 292/251.5; 292/216
(58) Field of Search ..... 292/216, 201, 292/251.5; 70/264, 276

(56) References Cited

U.S. PATENT DOCUMENTS

| | | | | |
|---|---|---|---|---|
| 3,976,962 A | | 8/1976 | Seeley | |
| 4,627,251 A | * | 12/1986 | Bhate | 70/276 |
| 4,752,092 A | * | 6/1988 | Faust | 292/336.3 |
| 4,802,350 A | * | 2/1989 | Periou | 70/264 |
| 4,978,153 A | * | 12/1990 | Hirsch | 292/201 |
| 4,995,658 A | * | 2/1991 | Shiraki | 292/336.3 |
| 4,998,447 A | * | 3/1991 | Feichtiger | 74/502.6 |
| 5,088,347 A | * | 2/1992 | Wanlass | 74/625 |
| 5,664,449 A | * | 9/1997 | Sedley | 70/276 |
| 5,975,596 A | * | 11/1999 | Rogers | 292/216 |
| 6,027,148 A | * | 2/2000 | Shoemaker | 292/216 |

FOREIGN PATENT DOCUMENTS

| | | |
|---|---|---|
| DE | 196 27 246 | 1/1997 |
| GB | 1 580 167 | 11/1980 |
| GB | 2 279 991 | 1/1995 |
| GB | 2 339 236 | 1/2000 |

* cited by examiner

*Primary Examiner*—Gary Estremsky
(74) *Attorney, Agent, or Firm*—Carlson, Gaskey & Olds

(57) ABSTRACT

An actuator including a device for providing a magnetic field including a magnetic field generator, the actuator further including an output element being moveable between a first position where it blocks or breaks an associated mechanical transmission path and a second position where it unblocks or forms part of an associated mechanical transmission path, the output element being moveable as a result of changes in its local magnetic field as generated by the magnetic field generator, at least a part of the device being moveable to change said local magnetic field to effect movement of the output element.

37 Claims, 8 Drawing Sheets

SUPER LOCKED

SUPER LOCKED

LOCKED – CHILD SAFETY ON

UNLOCKED – CHILD SAFETY ON

LOCKED CHILD SAFETY OFF

UNLOCKED CHILD SAFETY OFF

RELEASE

ACTUATOR

This application claims priority from United Kingdom patent application GB0018102.4 filed on Jul. 25, 2000.

BACKGROUND OF THE INVENTION

The present invention relates to actuators, and in particular actuators for latch mechanisms for doors of vehicles.

Actuators in latch mechanisms of door are known whereby movement of a cam effects movement of an associated cam follower. However, such arrangements are subject to wear and appropriate cam profiles can be difficult to manufacture.

SUMMARY OF THE INVENTION

An object of the present invention is to provide an improved form of actuator whereby some or all of the above mentioned problems are obviated.

An actuator including a device for providing a magnetic field including a magnetic field generator, the actuator further including an output element being moveable between a first position where it blocks or breaks an associated mechanical transmission path and a second position where it unblocks or forms part of an associated mechanical transmission path, the output element being moveable as a result of changes in its local magnetic field as generated by the magnetic field generator, at least a part of the device being moveable to change said local magnetic field to effect movement of the output element.

An actuator including a device for providing a magnetic field including a magnetic field generator the actuator further including an output element being moveable between a first position where it breaks an associated mechanical transmission path and a second position where it forms part of an associated mechanical transmission path, the output element being moveable as a result of changes in its local magnetic field as generated by the magnetic field generator, the device being operable to change said local magnetic field to effect movement of the output element, in which the actuator is caused to move during subsequent operation of an associated transmission path.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 2 is the latch mechanism of FIG. 1 in a locked position with child safety on;

FIG. 3 is the latch mechanism of FIG. 1 in an unlocked condition with the child safety on;

DETAILED DESCRIPTION OF THE PREFERRED EMBODIMENT

Figure 1:
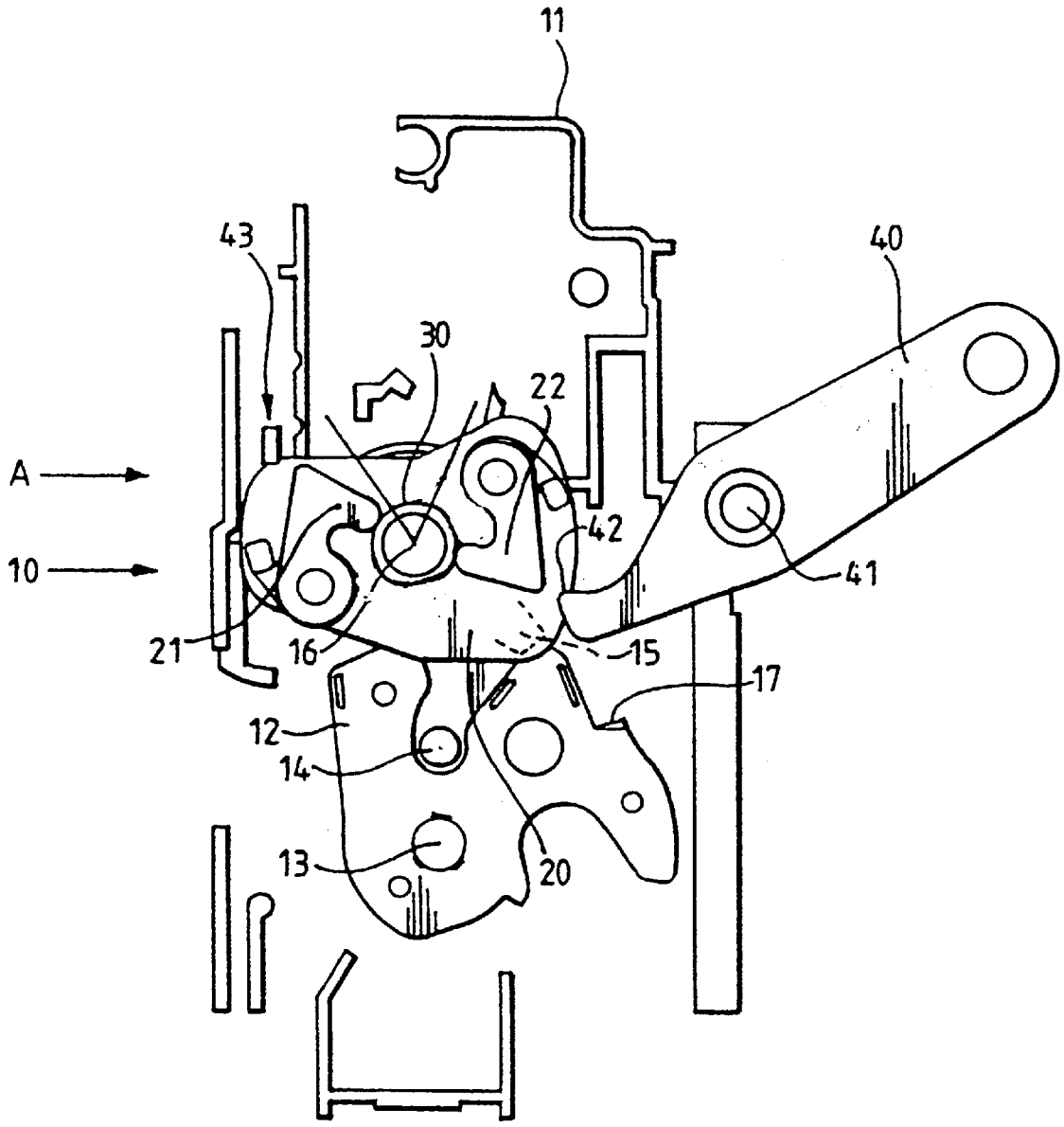
FIG. 1 is a latch mechanism in a super-locked condition including an actuator according to the present invention.

With reference to FIGS. 1–6 there is shown a latch mechanism 10 including a body 11 which supports various components of the latch mechanism 10 as indicated below.

Latch mechanism 10 further includes a claw 12 pivotally mounted about axis 13 on the body 11. Claw 12 acts to secure an associated door (not shown) in a closed position via a striker pin 14 attached to the door aperture. Rotation of the claw 12 in an anticlockwise direction about axis 13 when viewing FIG. 1 allows release of the striker pin 14, thus enabling opening of the associated door.

The claw 12 is held in a closed position by a pawl 15, only part of which is shown in dotted profile in FIG. 1 for clarity. Pawl 15 is pivotally mounted on body 11 and can rotate about axis 16. Claw 12 can be held in a first safety position (not shown) when pawl 15 engages first safety abutment 17.

Pawl lifter 20 is generally flat and lies in a plane parallel to pawl 15, to which it is rotationally secured. When viewing FIG. 1 pawl 15 is obscured by pawl lifter 20. Clearly, pawl lifter 20 also rotates about axis 16.

An output element in the form of an inside lock link 21 and a further output element in the form of outside lock link 22 are mounted for movement with the pawl, in this case they are each individually pivoted about respective axes 21*a* and 22*a* on pawl lifter 20. In this case inside lock link 21 and outside lock link 22 are identical and each have respective north magnetic poles 21*b* and 22*b* and release abutments 21*c* and 22*c*.

Figure 1A:
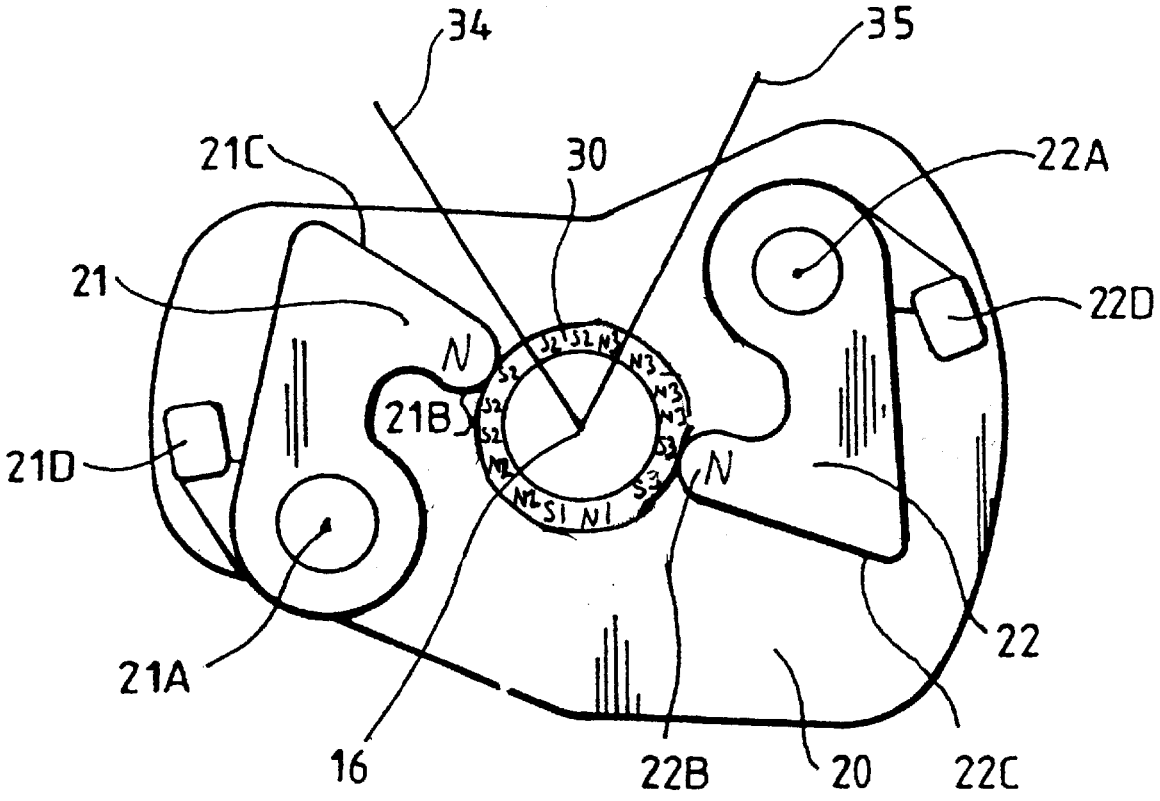
FIG. 1*a* is an enlarged view of part of FIG. 1.

Magnetic field generator 30 is capable of rotating independently from pawl lifter 20 about axis 16. Magnetic field generator 30 has three sets of south magnetic poles S1, S2 and S3 and three sets of north magnetic poles N1, N2 and N3 shown diagrammatically in FIG. 1A for clarity. The magnetic field generator 30 further includes levers 34 and 35 shown schematically which are all rotationally fast with magnetic field generator 30. Preferably magnetic field generator 30 can at least be rotated to the various positions as described below by a power actuator 100 such as a DC motor or preferably a stepper motor.

Figure 1B:
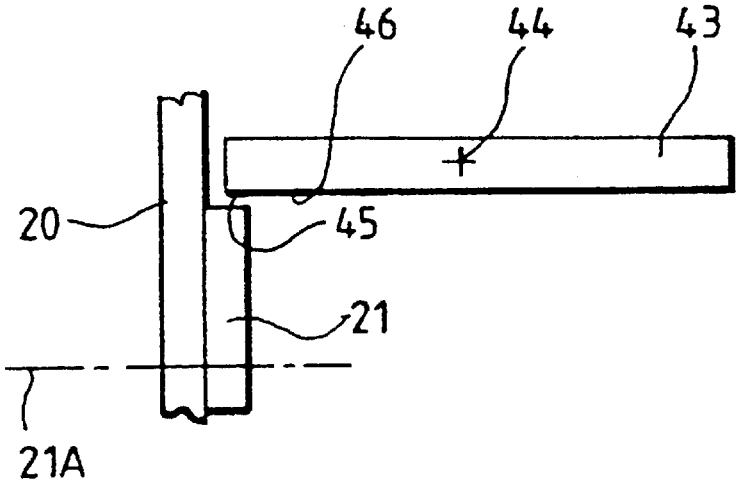
FIG. 1*b* is a schematic view in the direction of arrow A of FIG. 1.

Outside release lever 40 is pivotally mounted about axis 41 and is connected to an outside door handle. Inside release lever 43 (shown diagrammatically in FIG. 1*b*) is pivotally mounted about axis 44 and is connected to an inside door handle.

Operation of a door latch mechanism is as follows.

FIG. 1 shows the door latch mechanism in a super lock condition, that is to say operation of the outside release lever 40 or inside release lever 43 does not allow unlatching of the mechanism. In this case north magnetic pole 21*b* has being attracted to south magnetic pole set S2 and north magnetic pole 22*b* has being attracted towards south magnetic poles set S3. In particular it can be seen that if outside release lever 40 were to be operated by being rotated in a clockwise direction about axis 41, abutment 42 would pass release abutment 22*c* of outside lock link 22 without contact (note that outside release lever 40 is in the same plane as outside lock link 22). Similarly inside release lever 43 when operated by being rotated in an anticlockwise direction about axis 44 when viewing FIG. 1*b*, would cause abutment 45 to pass release abutment 21*c* of inside lock link 21 (see especially FIG. 1).

Figure 2:
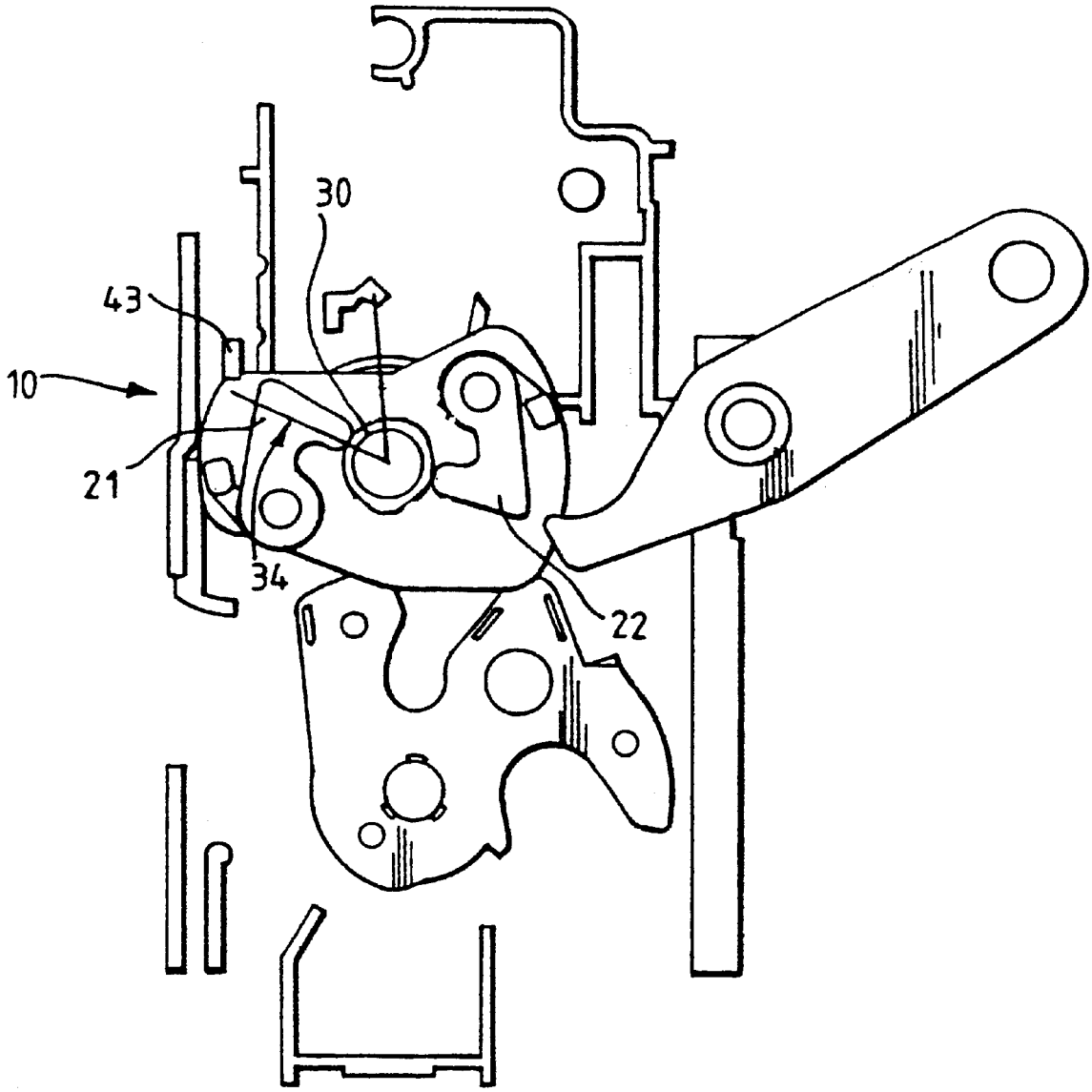

FIG. 2 shows the door latch mechanism 10 in a locked position with the child safety feature on. Magnetic field generator 30 has been rotated in an anticlockwise direction when compared to FIG. 1. However, the inside lock link 21 and outside lock link 22 are in the same position when compared with FIG. 1 since the north magnetic poles 21*b* and 22*b* are still attracted to respective south magnetic poles sets S2 and S3. As such no change in magnetic field has occurred in a region local to magnetic poles 21*b* and 22*b* and as such no movement of the output element takes place. However, lever 34 has been rotated to a position whereby operation of the inside release lever 43 in an anticlockwise direction when viewing FIG. 1*b* would cause abutment 46 to contact lever 34 and rotate magnetic field generator 30 to the position shown in FIG. 3. Note this initial operation of inside release lever 43 does not unlatch the mechanism but only operates to unlock the door (see below). This method of being able to override and open a locked door which has the child safety on is especially important in an emergency situation whereby a passer-by can effect access to the inside door handle (e.g. by breaking the door window glass), operate the inside door handle to unlock the door, then operate the outside door handle to open the door and then remove the child from the car.

Figure 3:
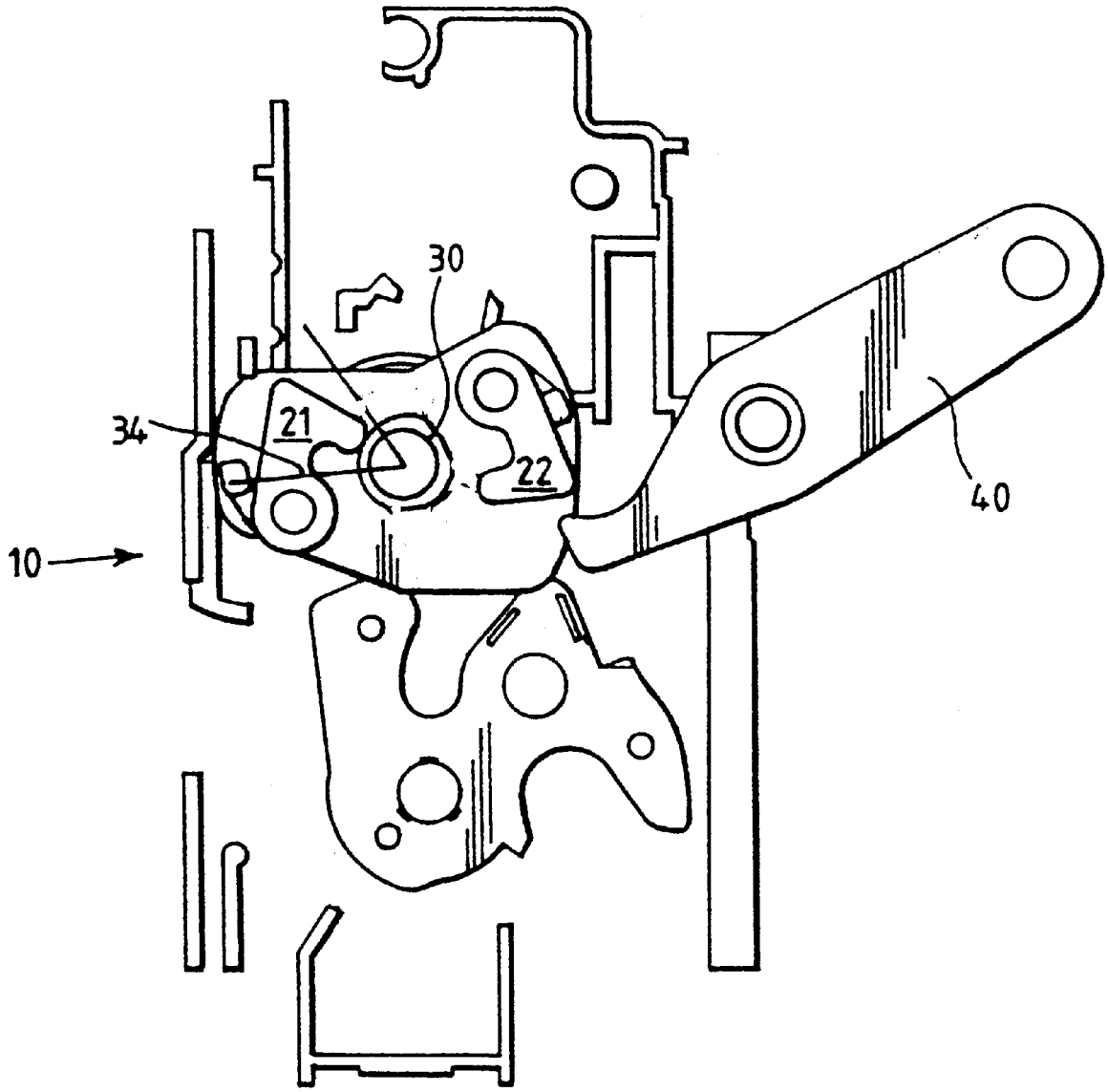

FIG. 3 shows the door latch mechanism 10 in an unlocked condition with the child safety feature on. In this case the magnetic field generator has been rotated sufficiently (either by operating the inside release lever when the magnetic field generator was in the position shown in FIG. 2 or by independent rotation of the magnetic field generator directly e.g. by a power actuator) such that north magnetic pole 21*b* is attracted towards the magnetic field generator but north magnetic pole 22*b* is repelled away from the magnetic field generator resulting in anticlockwise rotation of outside lock link 22. Thus when outside release lever 40 is operated, abutment 42 contacts release abutment 22*c* causing the pawl lifter 20 as a whole to rotate anticlockwise when viewing FIG. 3 and releasing the pawl 15 and allowing the claw 12 to open. Stop 22*d* limits the anticlockwise rotation of outside lock link 22. Upon release of the outside release lever 40 the pawl lifter 20 is biased back to the position as shown in FIG. 3 by a spring (not shown). It should also be noted that the inside lock link 21 is in the same position as that shown in FIG. 1, thus operation of the inside release lever 43 does not allow opening of the door.

It should be noted that lock link 21 has remained in the same position as shown in FIG. 3 and FIG. 2 since the magnetic field in the region local to the magnetic pole 21*b* has remained unchanged.

However, consideration of the magnetic field local to magnetic pole 22*b*, but as generated by the magnetic field generator 30 shows that there has been a change. Thus as shown in FIG. 2 the local magnetic field as generated by the magnetic field generator, in the region of magnetic pole 22*b* is a south pole.

Consideration of FIG. 3 shows that the magnetic field, as generated by the magnetic field generator, in the region of magnetic pole 22*b* is now a north pole. Thus, it is the change in magnetic field as generated by the magnetic field generator that causes the lock link 22 to move. Furthermore, for a change in magnetic field to have an effect on lock link 22, that change in magnetic field must, necessarily, be local to the lock link 22.

Figure 4:
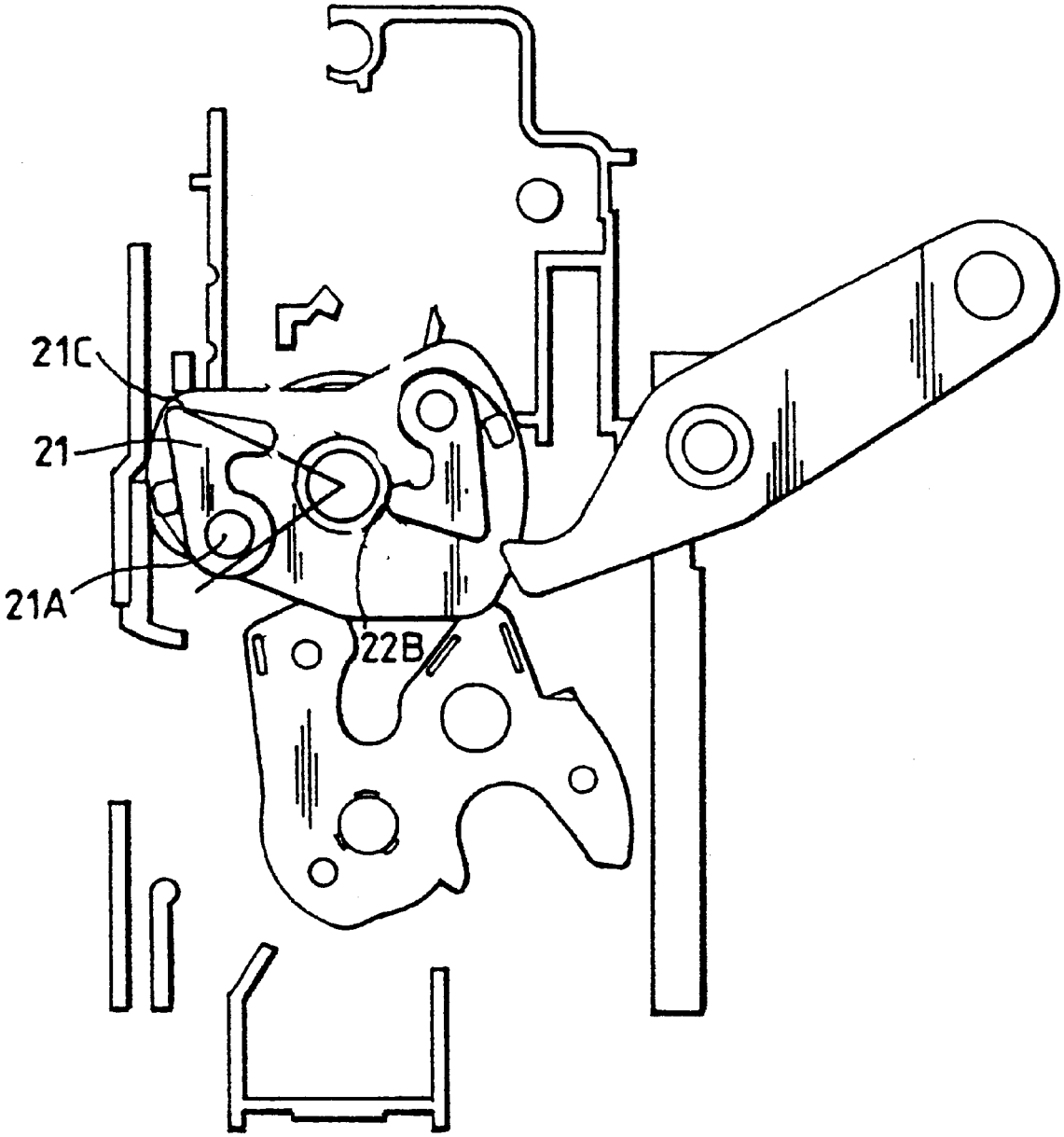
FIG. 4 is the latch mechanism of FIG. 1 in a locked condition with the child safety off.

FIG. 4 shows the door latch mechanism 10 in a locked condition with the child safety feature off. It should be noted that the magnetic field generator 30 has been rotated in an anticlockwise direction when compared with FIG. 1. This results in north magnetic pole 22*b* being attracted towards the magnetic field generator and ensuring that operation of outside release lever 40 does not release the latch mechanism. Furthermore, the rotation of the magnetic field generator 30 has caused north magnetic pole 21*b* to be repelled from the magnetic field generator causing inside lock link 21 to rotate anticlockwise about axis 21*a*. Thus abutment 21*c* of inside lock link 21 is contacted by abutment 45 of inside release lever 43 when it is operated. This causes anticlockwise rotation of the pawl lifter 20 about axis 16 resulting in unlatching of the door mechanism and allowing the door to be subsequently opened. Stop 21*d* limits the anticlockwise rotation of inside lock link 21. It should be noted that the operation of the inside release lever 43 also causes abutment 46 to contact lever 35 causing rotation of magnetic field generator 30 to the position shown in FIG. 5. This prevents a vehicle occupant inadvertedly locking himself out of the vehicle since opening of the door from the inside automatically unlocks the door, allowing subsequent opening from the outside.

Figure 5:
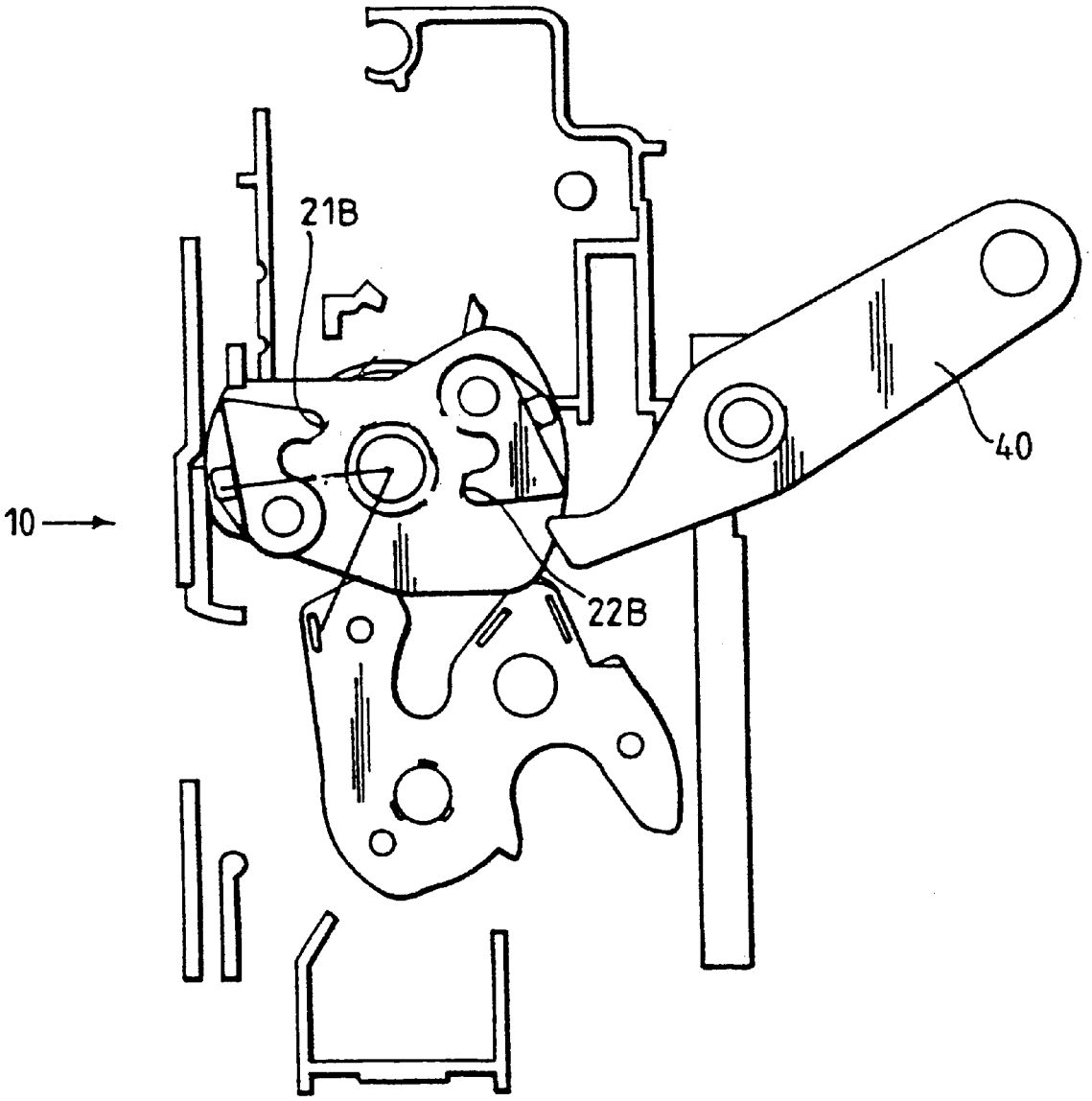
FIG. 5 is the latch mechanism of FIG. 1 in an unlocked position with the child safety off.

FIG. 5 shows the door latch mechanism 10 in an unlocked position with the child safety feature off. It can be seen that the magnetic field generator has been rotated (either by operating the inside release lever when the magnetic field generator was in the position shown in FIG. 4 or by independent rotation of the magnetic field generator directly e.g. by a power actuator) such that north magnetic pole 22*b* is repelled away from the magnetic field generator 30 allowing operation of the outside release lever 40 to unlatch the latch mechanism as described above. Furthermore north magnetic pole 21*b* is repelled away from the magnetic field generator 30 thus ensuring that operation of the inside release lever also unlatches the door mechanism.

Figure 6:
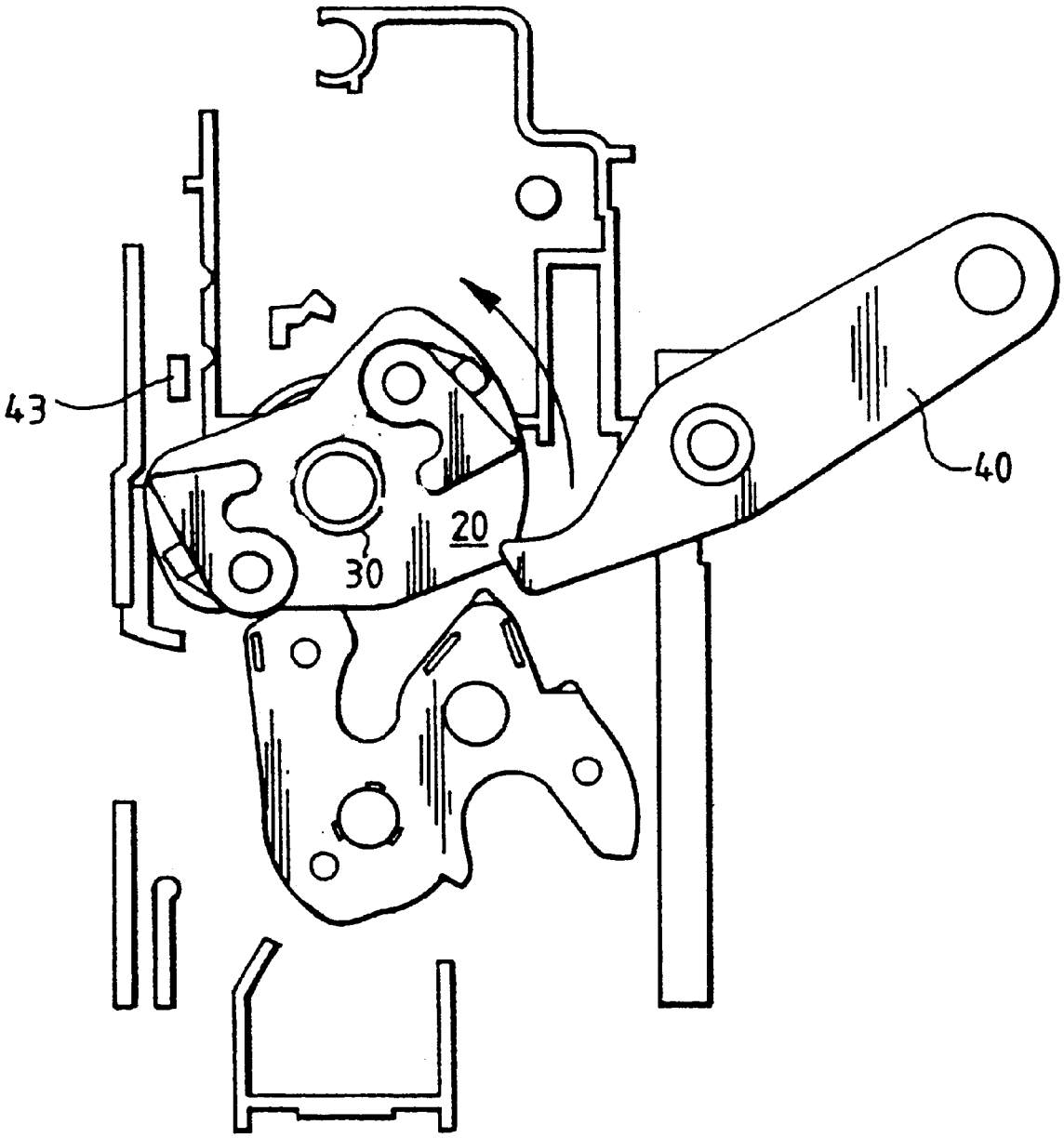
FIG. 6 is a latch mechanism of FIG. 1 in a release position.

FIG. 6 shows the door latch mechanism 10 in a released position. This is achieved by rotation of magnetic field generator 30 in a anticlockwise direction which allows contact between corresponding lost motion abutments (not shown) on the pawl lifter 20 and magnetic field generator 30. Such lost motion abutments allow the magnetic field generator 30 to rotate the pawl lifter 20 to release the door latch mechanism independently of the operation of the outside release lever 40 or the inside release lever 43.

In this case the combination of the magnetic field generator 30 and inside lock link provides for an actuator according to the present invention. Furthermore the combination of the magnetic field generator 30 and the outside lock link provide for a further actuator according to the present invention. Thus in this particular case two actuators according to the present invention are provided having a common magnetic field generator.

It should also be noted that with the door in an unlocked condition there is a transmission path between the inside door handle and the pawl 15. This transmission path includes amongst, other release lever 43 and inside lock link 21. A further transmission path is provided between the outside door handle and the pawl 15 which includes, amongst others, the outside release lever 40 and the outside lock link 22.

Note that with the latch mechanism in a superlocked condition the inside lock lever breaks the transmission path between the inside door handle and the pawl 15 and the outside lock lever 22 breaks the transmission path between the outside door handle and the pawl 15.

However, with the latch mechanism in the unlocked condition the inside lock lever forms part of the transmission path between the inside door handle and the pawl and the outside lock link forms part of the transmission path between the outside door handle and the pawl.

In this case locking of the latch mechanism is of the free wheeling type i.e. with the door in a locked condition operation of an outside door handle is possible but does not open the latch.

In further embodiments of the present invention an actuator according to the present invention may be provided which provides for block type locking i.e. the output element of the actuator prevents movement of say an outside door handle.

In further embodiments the inside and outside lock links can be mounted directly on the pawl.

In the embodiments shown the magnetic field generator comprises an array of north and south magnetic poles and the output elements also include a magnetic pole (in this case a north magnetic pole). In further embodiments the array of magnetic poles on the magnetic field generator can be varied as can the polarity of the magnetic poles on the output element.

In a further embodiment the output elements need not include any magnetic poles but could consist of a material that is attracted to both a north and south magnetic pole of the magnetic field generator under these circumstances it would be possible to arrange for a resilient means to bias the output elements away from the magnetic field generator when a neutral magnetic field is generated in the vicinity of the output elements and when a magnetic field, either north or south is generated in the vicinity of the output element then that output element would be attracted towards the magnetic field generator.

In further embodiments the magnetic field generator could be in the form of one or more electro-magnetics. Furthermore one or more output elements could include an electromagnet arrangement.

In a yet further embodiment it is not necessary to move the magnetic field generator since it is possible to shield the output elements from the magnetic field generated by the magnetic field generator. To this end a magnetic shield could be moved between the output element and the magnetic field generator to effect a change in the magnetic field local to the output element.

Figure 7:
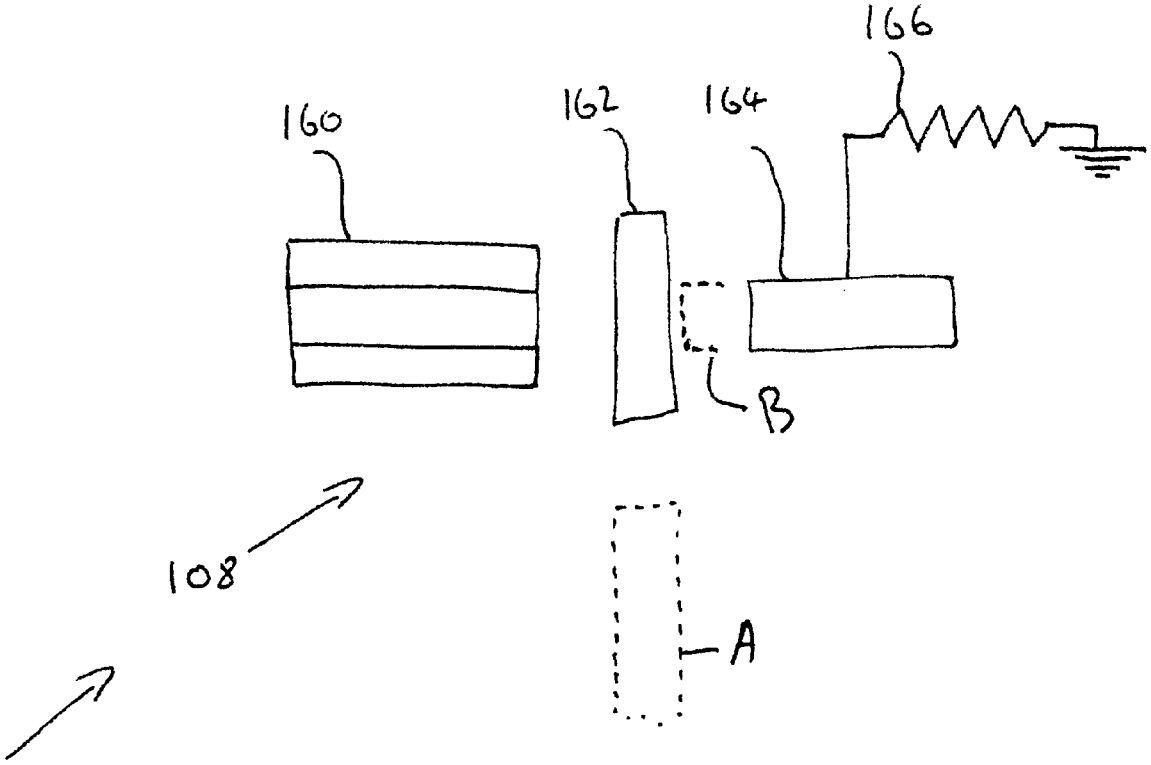
FIG. 7 is a further schematic embodiment of an actuator according to the present invention.

Consideration of FIG. 7 shows, schematically, an actuator 108 having an electro magnetic 160, a moveable shield 162, and an output element 164 which is bias to the position as shown in FIG. 7 by spring 166.

With the magnetic shield 162 in the position as shown in FIG. 7, the output element 164 is bias to the position as shown in FIG. 7 by spring 166.

However, when the magnetic shield 162 is moved to the lower chain dotted position A, then the output element 164 is no longer shielded from the effects of the magnetic field as generated by the electro magnet 160, and moves to the position shown chain dotted at B.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. An actuator comprising:

a powered actuator;

a device for providing a magnetic field including a magnetic field generator; and an output element being moveable between a first position where the output element disables an associated mechanical transmission path and a second position where the output element enables an associated mechanical transmission path, the output element being moveable as a result of changes in a local magnetic field as generated by the magnetic field generator, at least a part of the device being moveable by the power actuator to change said local magnetic field to effect movement of the output element.

2. An actuator as defined in claim 1 in which said part of the device includes the magnetic field generator, said magnetic field generator being movable by the power actuator to change said local magnetic field to effect said movement of the output element.

3. An actuator as defined in claim 1 in which said device further includes a magnetic shield, the shield being moveable to change said local magnetic field to effect said movement of the output element.

4. An actuator as defined in claim 1 in which the magnetic field generator is a permanent magnetic.

5. An actuator as defined in claim 1, in which the magnetic field generator is an electromagnet.

6. A latch mechanism comprising;

a power actuator;

a device for providing a magnetic field having a magnetic field generator; and an output element being moveable between a first position where the output element disables an associated mechanical transmission path and a second position where the output element enables an associated mechanical transmission path, the output element being moveable as a result of changes in its local magnetic field as generated by the magnetic field generator, at least a part of the device being moveable by the power actuator to change said local magnetic field to effect movement of the output element, the latch mechanism including a housing, a pawl movably mounted in the housing to release the latch mechanism, the output element forming a lock link mounted for movement with the pawl with the output element in a first position, operation of an associated release means causes movement of the pawl to release the latch, and with the output element in the second position operation of the associated release means does not cause movement of the pawl.

7. A latch mechanism as defined in claim 6 in which the pawl is rotatably mounted in the housing.

8. A latch mechanism as defined in claim 6 in which a pawl lifter is connected to a pawl and the lock link is mounted on the pawl lifter.

9. A latch mechanism as defined in claim 6 in which the lock link is pivotally mounted for rotational movement between its first and second positions.

10. A latch mechanism as defined in claim 6 further including a further actuator having a further output element forming another of an inside or outside lock link in which the inside and outside lock link are both mounted for movement with the pawl.

11. A latch mechanism as defined in claim 6 in which indexing of the magnetic field generator effects movement of the at least one lock link between its first and second positions.

12. A latch mechanism as defined in claim 11, in which the magnetic field generator is rotationally mounted for indexing.

13. A latch mechanism as defined in claim 12 in which the magnetic field generator is rotationally mounted co-axially with the pawl.

14. A latch mechanism as defined in claim 11 in which the magnetic field generator includes at least two discrete equivalent magnetic poles which position the at least one lock link in one of the first and second positions, with the at least two discrete equivalent magnetic poles being separated by an alternate magnetic pole which positions the at least one lock link in the other of the first and second positions.

15. A latch mechanism as defined in claim 10 in which the magnetic field generator of the actuator is common with the magnetic field generator of the further actuator to effect movement of both the inside and outside lock links.

16. A latch mechanism as defined in claims 11 in which the release means is capable of indexing the magnetic field generator to move at least one of the lock links between the first and second positions.

17. A latch mechanism as defined in claim 16 in which the release means is capable of indexing the magnetic field generator to move at least one of the lock links from its second position to its first position.

18. A latch mechanism as defined in claim 6 in which movement of the at least one lock link between its first and second position is effected by a power actuator.

19. A latch mechanism as defined in claim 6 in which the pawl is capable of being moved to release the latch by a power actuator.

20. A latch mechanism as defined in claim 19 in which the power actuator further effects movement of the at least one lock link between its first and second positions.

21. A latch mechanism as defined in claim 20 in which the power actuator drives the magnetic field generator such that an abutment on the magnetic field generator operatively co-acts with an abutment fast with the pawl to release the latch mechanism.

22. A latch mechanism comprising;

a power actuator;

a device for providing a magnetic field including a magnetic field generator; and an output element being moveable between a first position where it inhibits an associated mechanical transmission path and a second position where the output element allows function of an associated mechanical transmission path, the output element being moveable as a result of changes in a local magnetic field as generated by the magnetic field generator, at least part of the device being movable by the power actuator to change said local magnetic field to effect movement of the output element, in which said output element is caused to move during subsequent operation of said associated transmission path, the latch mechanism includes a housing, a pawl movably mounted in the housing to release the latch, the output element forming a lock link mounted for movement with the pawl with the output element in a first position, operation of an associated release means causes movement of the pawl to release the latch, and with the output element in the second position operation of the associated release means does not cause movement of the pawl.

23. A latch mechanism as defined in claim 22 in which the pawl is rotatably mounted in the housing.

24. A latch mechanism as defined in claim 22 in which a pawl lifter is connected to a pawl and the lock link is mounted on the pawl lifter.

25. A latch mechanism as defined in claim 22 in which the lock link is pivotally mounted for rotational movement between its first and second positions.

26. A latch mechanism as defined in claim 22 further including a further actuator arrangement according to claim 22 having a further output element forming another of an inside or outside lock link in which the inside and outside lock link are both mounted for movement with the pawl.

27. A latch mechanism as defined in claim 22 in which indexing of the magnetic field generator effects movement of the at least one lock link between its first and second positions.

28. A latch mechanism as defined in claim 27 in which the magnetic field generator is rotationally mounted for indexing.

29. A latch mechanism as defined in claim 28 in which the magnetic field generator is rotationally mounted co-axially with the pawl.

30. A latch mechanism as defined in claim 27 in which the magnetic field generator includes at least two discrete equivalent magnetic poles which position the at least one lock link in one of the first and second positions, with the at least two discrete equivalent magnetic poles being separated by an alternate magnetic pole which positions the at least one lock link in the other of the first and second positions.

31. A latch mechanism as defined in claim 26 in which the magnetic field generator of the actuator is common with the magnetic field generator of the further actuator to effect movement of both the inside and outside lock links.

32. A latch mechanism as defined in claims 27 in which the release means is capable of indexing the magnetic field generator to move at least one of the lock links between the first and second positions.

33. A latch mechanism as defined in claim 32 in which the release means is capable of indexing the magnetic field generator to move at least one of the lock links from its second position to its first position.

34. A latch mechanism as defined in claim 22 in which movement of the at least one lock link between its first and second position is effected by a power actuator.

35. A latch mechanism as defined in claim 22 in which the pawl is capable of being moved to release the latch by a power actuator.

36. A latch mechanism as defined in claim 35 in which the power actuator further effects movement of the at least one lock link between its first and second positions.

37. A latch mechanism as defined in claim 36 in which the power actuator drives the magnetic field generator such that an abutment on the magnetic field generator operatively co-acts with an abutment fast with the pawl to release the latch mechanism.

* * * * *